US009510097B1

(12) United States Patent
Tsai

(10) Patent No.: US 9,510,097 B1
(45) Date of Patent: Nov. 29, 2016

(54) ELECTRONIC DEVICE AND WATERPROOF SHEET THEREOF

(71) Applicant: Chicony Electronics Co., Ltd., New Taipei (TW)

(72) Inventor: Pei-Sheng Tsai, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 14/729,837

(22) Filed: Jun. 3, 2015

(51) Int. Cl.
*H04R 1/02* (2006.01)
*H04R 5/02* (2006.01)
*H04R 1/04* (2006.01)

(52) U.S. Cl.
CPC ..... *H04R 5/02* (2013.01); *H04R 1/028* (2013.01); *H04R 1/04* (2013.01); *H04R 2499/11* (2013.01)

(58) Field of Classification Search
None
See application file for complete search history.

(56) References Cited

U.S. PATENT DOCUMENTS

2002/0009580 A1* 1/2002 Phillips ..... B05D 1/30 428/220
2010/0247857 A1* 9/2010 Sanami ..... H04M 1/18 428/138
2011/0117304 A1* 5/2011 Ueki ..... H04R 1/023 428/36.5
2012/0195451 A1* 8/2012 Nakata ..... A45C 11/00 381/334
2014/0294217 A1* 10/2014 Yamaguchi ..... H04M 1/035 381/334
2015/0146905 A1* 5/2015 Abe ..... H04R 1/086 381/334

* cited by examiner

*Primary Examiner* — Thang Tran
(74) *Attorney, Agent, or Firm* — Muncy, Geissler, Olds & Lowe, P.C.

(57) ABSTRACT

An electronic device and a waterproof sheet thereof are provided. The electronic device includes a housing having a sound guiding opening, a sound unit assembled inside the housing and positioned with the sound guiding opening, and a waterproof sheet covering the sound guiding opening and including a waterproof foam layer and a waterproof double-sided adhesive layer. The waterproof foam layer includes an outer side surface and an inner side surface. The waterproof double-sided adhesive layer includes a waterproof foam member, first and second waterproof adhesive side surfaces adapted to two surfaces of the waterproof foam member. The first waterproof adhesive side surface is bonded to the inner side surface. The waterproof double-sided adhesive layer further includes a central through hole passing through the waterproof double-sided adhesive layer and positioned with the sound guiding opening. The second waterproof adhesive side surface is bonded to the outer surface of the housing.

20 Claims, 7 Drawing Sheets

ELECTRONIC DEVICE AND WATERPROOF SHEET THEREOF

BACKGROUND

Technical Field

The instant disclosure relates to an electronic device. In particular, the instant disclosure relates to an electronic device having a sound unit, and to a waterproof sheet of the electronic device.

Related Art

As technology advances, many consumer electronic devices (e.g., smart phones, tablet computers, notebook computers, digital cameras, etc.), have a speaker, microphone, or other audio features. In addition, the housing of the electronic device probably defines a via hole at a position aligned with the microphone and speaker for outputting or receiving sounds. However, external moisture may enter into the speaker, the microphone, or the electronic device from the via hole, causing damage. Consequently, many electronic devices may have waterproof structures defined at the speaker and the microphone.

The existing waterproof structures are typically specified waterproof permeable films covered out of the via hole of the microphone and the speaker, so as to prevent moist penetration. However, in manufacturing and assembling practice, the existing specified waterproof structures are both costly and insufficient to perform a proper waterproof function (the waterproof function of the typical waterproof structure cannot be sufficiently performed beyond a threshold underwater depth, and the threshold underwater depth is in a range from 3 m to 5 m). Additionally, if the existing waterproof structures are touched during manufacturing, assembly, or operation, efficacy of the waterproof function will be reduced or even fail. Consequently, the related personnel are involved in the improvement of the existing waterproof structures.

SUMMARY

In view of these problems, an exemplary embodiment of the instant disclosure provides an electronic device comprising a housing, a sound unit, and a waterproof sheet. The housing has a sound guiding opening. The sound unit is assembled inside the housing and positioned with the sound guiding opening. The waterproof sheet is covering the sound guiding opening. The waterproof sheet comprises a waterproof foam layer and a waterproof double-sided adhesive layer. The waterproof foam layer comprises an outer side surface and an inner side surface opposite to the outer side surface. The waterproof double-sided adhesive layer comprises a waterproof foam member, a first waterproof adhesive side surface, and a second waterproof adhesive side surface. The first waterproof adhesive side surface and the second waterproof adhesive side surface are adapted to two opposite surfaces of the waterproof foam member, respectively. The first waterproof adhesive side surface is bonded to the inner side surface of the waterproof foam layer. The waterproof double-sided adhesive layer further comprises a central through hole passing through the waterproof foam member, the first waterproof adhesive side surface, and the second waterproof adhesive side surface. The second waterproof adhesive side surface is bonded to the outer surface of the housing, and the central through hole is positioned with the sound guiding opening.

Based on the above, the waterproof sheet comprises the waterproof foam layer and the waterproof double-sided adhesive layer, as compared with the typical specified waterproof permeable film, the manufacturing cost of the waterproof sheet can be reduced, and the waterproof performance of the waterproof sheet can be improved. In addition, since the waterproof performance of the waterproof sheet is unaffected by human finger touch, the convenience and the effectiveness for manufacturing and assembling the waterproof sheet can be increased, and the yield of the product can be improved greatly.

In one embodiment, the size of the central through hole is greater than or equal to the size of the sound guiding opening. In other words, the waterproof double-sided adhesive layer would not cover the sound guiding opening. Consequently, the sound will not be retarded by the waterproof double-sided adhesive layer, and will be of good quality.

In one embodiment, the sound unit may be a speaker unit or a microphone unit. For example, the sound unit can be a speaker unit, and the sound unit may comprise a vibrating film, a voice coil, a sound chamber, or other components. Alternatively, the sound unit can be a microphone unit, and the sound unit may comprise a vibrating film, a magnet, a coil, or other components.

In one embodiment, the edge of the waterproof double-sided adhesive layer is aligned with the edge of the waterproof foam layer. Based on this, the area where moisture may possibly collect can be reduced, and the waterproof performance of the waterproof sheet can be further improved.

In one embodiment, the waterproof sheet may further comprise an enforcing layer bonded to the outer side surface of the waterproof foam layer, wherein the enforcing layer comprises a central via hole positioned with the central through hole. In other words, the central via hole is positioned with the central through hole and the sound guiding opening. Consequently, the sound guiding opening is not covered by the enforcing layer. Therefore, the sound will not be blocked by the enforcing layer, and the sound quality will not be reduced. As a specific example, the enforcing layer may be a rigid material layer (e.g., plastic sheet or acrylic sheet), a polyester film or a waterproof foam layer.

Another embodiment of the instant disclosure provides a waterproof sheet comprising a waterproof foam layer and a waterproof double-sided adhesive layer. The waterproof foam layer comprises an outer side surface and an inner side surface opposite to the outer side surface. The waterproof double-sided adhesive layer comprises a waterproof foam member, a first waterproof adhesive side surface, and a second waterproof adhesive side surface. The first waterproof adhesive side surface and the second waterproof adhesive side surface are adapted to two opposite surfaces of the waterproof foam member, respectively. The first waterproof adhesive side surface is bonded to the inner side surface of the waterproof foam layer. The waterproof double-sided adhesive layer further comprises a central through hole passing through the waterproof foam member, the first waterproof adhesive side surface, and the second waterproof side surface.

Detailed description of the characteristics and the advantages of the disclosure is shown in the following embodiments. The technical content and the implementation of the disclosure should be readily apparent to any person skilled in the art from the detailed description, and the purposes and the advantages of the disclosure should be readily understood by any person skilled in the art with reference to content, claims and drawings in the disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
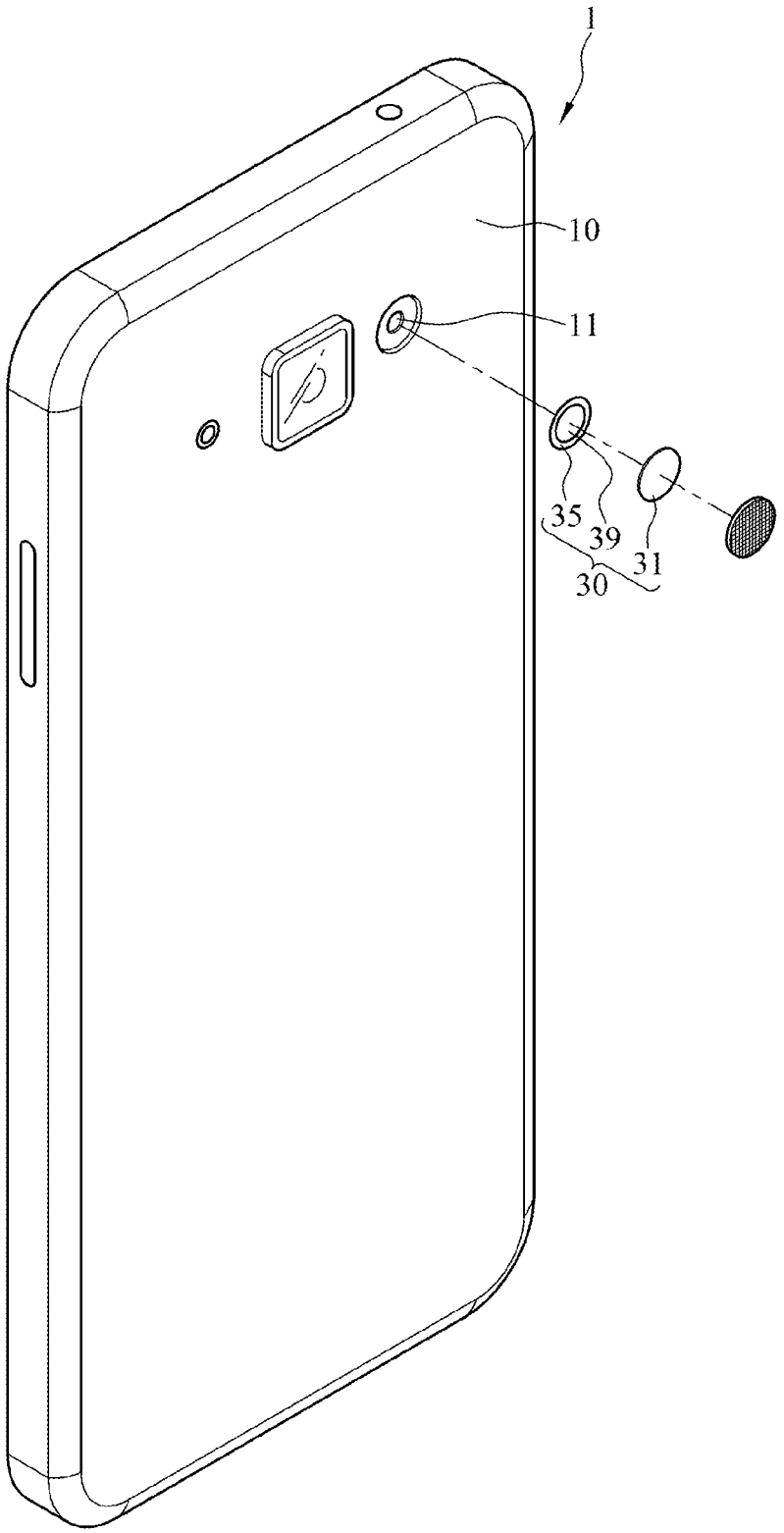
FIG. 1 is an exploded view of an electronic device according to an exemplary embodiment of the instant disclosure.
Figure 2:
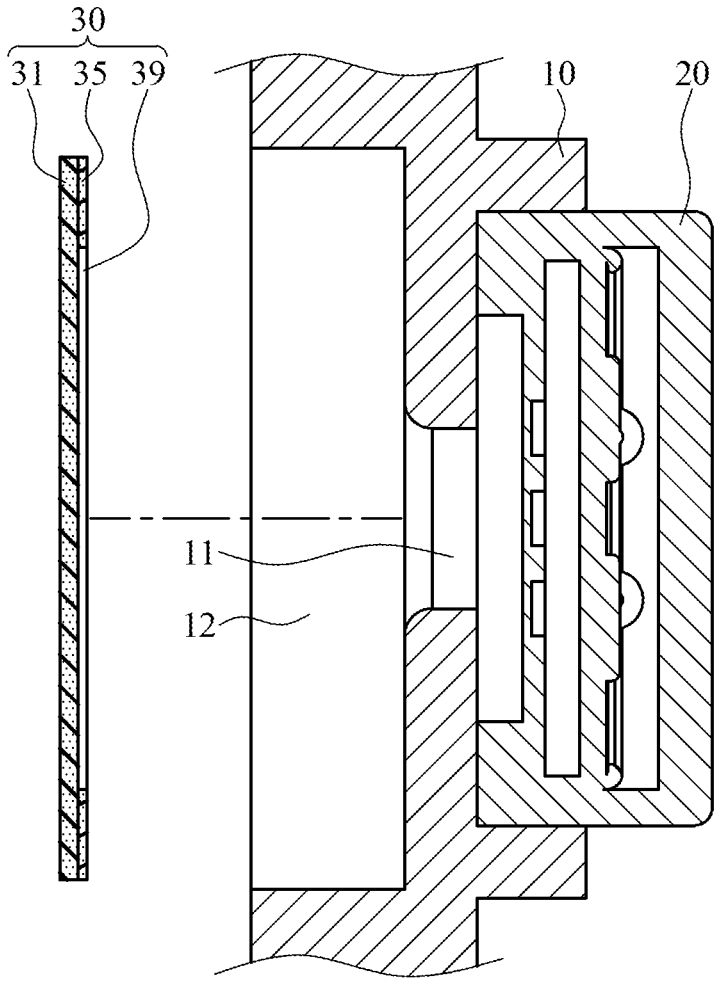
FIG. 2 is a partial exploded sectional view of the electronic device of FIG. 1.
Figure 3:
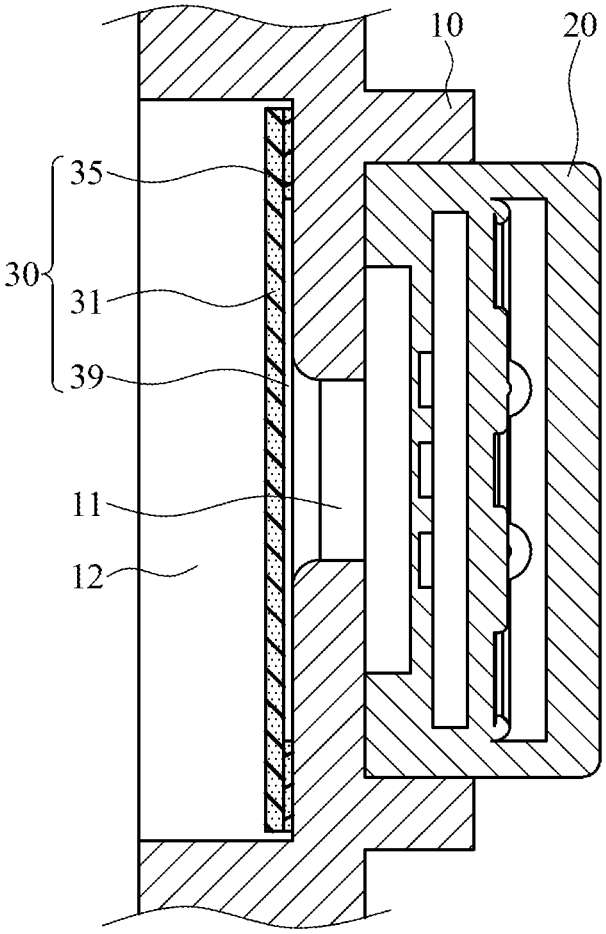
FIG. 3 is a partial sectional view of the electronic device of FIG. 1.
Figure 4:
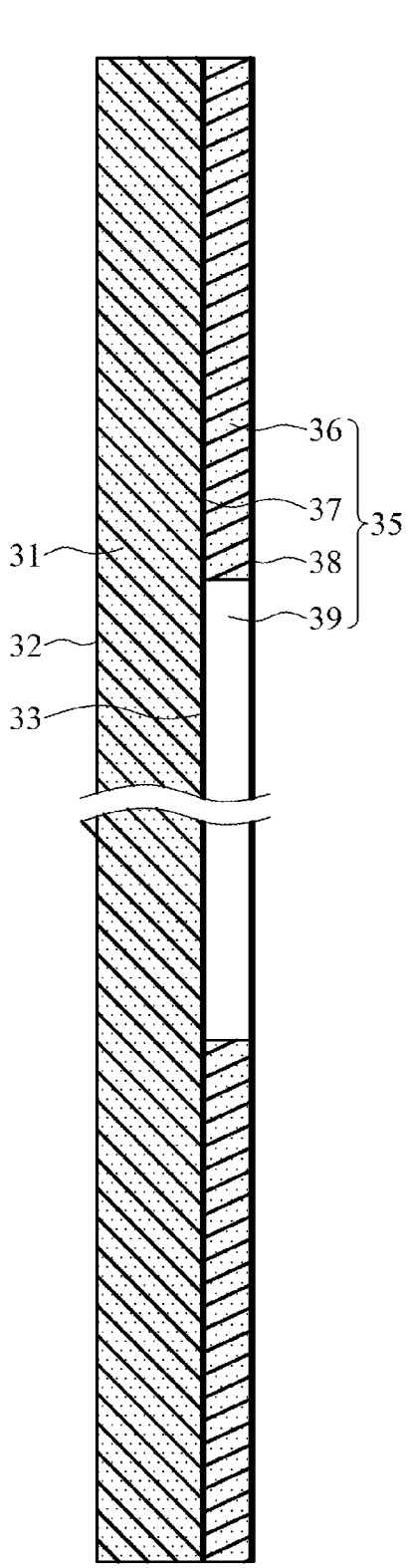
FIG. 4 is a sectional view of a waterproof sheet according to an exemplary embodiment of the instant disclosure.

Please refer to FIGS. 1 to 4. FIG. 1 is an exploded view of an electronic device 1 according to an exemplary embodiment of the instant disclosure. FIG. 2 is a partial exploded sectional view of the electronic device 1. FIG. 3 is a partial sectional view of the electronic device 1. FIG. 4 is a sectional view of a waterproof sheet 30 according to an exemplary embodiment of the instant disclosure. The electronic device 1 comprises a housing 10, a sound unit 20, and a waterproof sheet 30. The sound unit 20 may be a speaker unit; in other words, the sound unit 20 may be a member capable of outputting sounds. Alternatively, the sound unit 20 may be a microphone unit; in other words, the sound unit 20 may be a member capable of receiving sounds. For example, the sound unit 20 may comprise a vibrating film, a voice coil, a sound chamber, a circuit board, etc. for generating or receiving sounds. In this embodiment, the electronic device 1 is a smart phone, and the instant disclosure is not limited thereto. Alternatively, the electronic device 1 may be a tablet, a notebook computer, a stereo set, an earphone, or other electronic products having microphones or speakers (i.e., having the sound unit 20).

The housing 10 may be a plastic housing or a metal housing. The housing 10 has a sound guiding opening 11 located at one side thereof. The sound guiding opening 11 is in fluid communication with the interior of the housing 10. The sound unit 20 is assembled inside the housing 10. In this embodiment, the sound unit 20 is engaged in a recess formed in the housing 10 and positioned with the sound guiding opening 11, and the instant disclosure is not limited thereto. Alternatively, the sound unit 20 may be assembled inside the housing 10 by means of gluing or buckling. Therefore, the sound generated by the sound unit 20, which can be a speaker, can be guided to the outside through the sound guiding opening 11. In an alternative embodiment, the sound can be received by the sound unit 20, which can be a microphone, through the sound guiding opening 11.

In a preferred embodiment, the waterproof sheet 30 may have a thickness in the range from 0.5 mm to 1 mm, but the thickness of the waterproof sheet 30 may be equal to or greater than 1 mm or may be equal to or less than 0.5 mm. The waterproof sheet 30 comprises a waterproof foam layer 31 and a waterproof double-sided adhesive layer 35. In this embodiment, the waterproof foam layer 31 is disk-shaped and has certain thickness, and the instant disclosure is not limited thereto. Alternatively, the waterproof foam layer 31 may be of other shapes (e.g., rectangular, oval, or irregular shapes). The waterproof foam layer 31 comprises an outer side surface 32 and an inner side surface 33. The inner side surface 33 is facing the housing 10, and the inner side surface and the outer side surface 32 are opposite to each other. As a specific example, the waterproof foam layer 31 may be formed of a closed-cell foam which has low water absorption rate so as to perform sufficient waterproof function.

The waterproof double-sided adhesive layer 35 comprises a waterproof foam member 36, a first waterproof adhesive side surface 37, and a second waterproof adhesive side surface 38. The first waterproof adhesive side surface 37 and the second waterproof adhesive side surface 38 are adapted to two opposite surfaces of the waterproof foam member 36, respectively. The first waterproof adhesive side surface 37 is bonded to the inner side surface 33 of the waterproof foam layer 31 such that the waterproof double-sided adhesive layer 35 and the waterproof foam layer 31 can be combined. The waterproof double-sided adhesive layer 35 further comprises a central through hole 39 passing through the waterproof foam member 36, the first waterproof adhesive side surface 37, and the second waterproof adhesive side surface 38. In this embodiment, the waterproof double-sided adhesive layer 35 has an annular shape corresponding to the waterproof foam layer 31 which is disk-shaped, and the instant disclosure is not thus limited thereto. Alternatively, the shape of the waterproof double-sided adhesive layer 35 may correspond to the shape of the waterproof foam layer 31 and be altered according to need. The structure of the waterproof foam member 36 may be the same as that of the waterproof foam layer 31. In other words, the waterproof foam member 36 may be formed of a closed-cell foam which has low water absorption rate so as to perform sufficient waterproof function.

The first waterproof adhesive side surface 37 and the second waterproof adhesive side surface 38 may be waterproof adhesive surfaces made of acrylic, epoxy, silicone, or rubber. The second waterproof adhesive side surface 38 is bonded to the outer surface of the housing 10 to allow the waterproof sheet 30 to cover the sound guiding opening 11, and the central through hole 39 is positioned with the sound guiding opening 11. Additionally, in a preferred embodiment, the size (diameter) of the central through hole 39 is greater than or equal to the size (diameter) of the sound guiding opening 11, such that the waterproof double-sided adhesive layer 35 would not cover the sound guiding opening 11. Consequently, the sound would not be retarded by the waterproof double-sided adhesive layer 35 and will be of good quality. In addition, the first waterproof adhesive side surface 37 and the second waterproof adhesive side surface 38 can prevent moisture from penetrating inside through the junction between the waterproof foam layer 31 and the waterproof foam member 36, or through the junction between the waterproof sheet 30 and the housing 10.

Accordingly, as shown in FIGS. 3 to 4, the waterproof foam layer 31 is provided as a shield for preventing moisture or dust from penetrating inside the housing 10 through the sound guiding opening 11 to damage the sound unit 20. Additionally, the three waterproof layer (i.e., the waterproof foam member 36, the first waterproof adhesive side surface 37, and the second waterproof adhesive side surface 38), of the waterproof double-sided adhesive layer 35 of the waterproof sheet 30 further prevent moisture from penetrating inside through the junction between the waterproof foam layer 31 and the waterproof double-sided adhesive layer 35, or through the junction of the waterproof double-sided adhesive layer 35 and the housing 10 (i.e., prevent moisture from entering the housing 10 from the junction). As compared with a typical specified waterproof permeable film, the waterproof sheet 30 has a better waterproof performance (e.g., the waterproof function of the typical waterproof structure cannot be sufficiently performed beyond a threshold underwater depth in a range from 3 m to 5 m; while the waterproof function of the waterproof sheet 30 can be sufficiently performed to a threshold underwater depth not greater than a range from 10 m to 40 m). Furthermore, since the waterproof sheet 30 is mainly made of waterproof foam, the manufacturing cost of the waterproof sheet 30 can be reduced. Additionally, because the waterproof double-sided adhesive layer 35 has the central through hole 39 positioned with the sound guiding opening 11, the sound will not be retarded by the waterproof double-sided adhesive layer 35.

In addition, compared with the typical specified waterproof permeable film, the waterproof performance of the waterproof sheet 30 will not be affected by human finger touch, the convenience and the effectiveness for manufacturing and assembling the waterproof sheet 30 will be increased, and the yield of the product can be greatly improved. Details are described in the following paragraphs.

Figure 5:
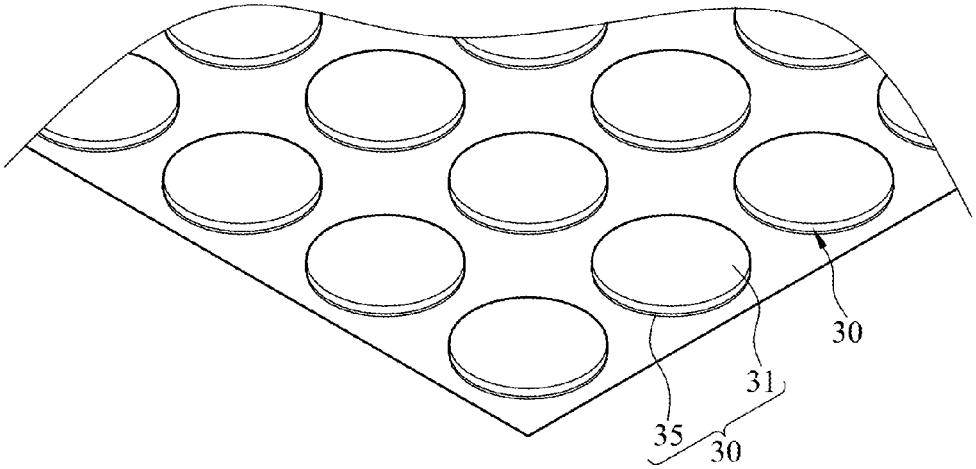
FIG. 5 is a perspective view of the waterproof sheet during one exemplary assembly step.

Please refer to FIG. 5. After the manufacture of the waterproof sheets 30, the waterproof sheets 30 can be adhered to release papers. Since the waterproof performance of the waterproof sheet 30 will not be affected by the oil brought by the human finger that is in touch with the surface of the waterproof sheet 30, the operating personnel can rapidly detach the waterproof sheet 30 from the release paper upon assembly. Next, as shown in FIGS. 1 to 2, the waterproof sheet 30 can be bonded to the outer surface of the housing 10 through the second waterproof adhesive side surface 38 thereof to cover the sound guiding opening 11 and perform the waterproofing function. Consequently, the convenience and the effectiveness for manufacturing and assembling the waterproof sheet 30 can be greatly improved.

Additionally, since the waterproof sheet 30 comprises the waterproof foam layer 31 and the waterproof double-sided adhesive layer 35 combined with each other, the adhesive surface of the waterproof sheet 30 is not exposed to air, preventing dust from adhering to the waterproof sheet 30. Consequently, the quality of the sound delivered through the waterproof sheet 30 will not be affected, and the working life of the waterproof sheet 30 can be extended.

As shown in FIGS. 2 to 3, in this embodiment, the housing 10 is formed with a recess 12 at one side thereof. The sound guiding opening 11 is in fluid communication with the recess 12, and the waterproof sheet 30 is positioned in the recess 12. The edge of the waterproof double-sided adhesive layer 35 is aligned with the edge of the waterproof foam layer 31. Base on this, the space where moisture may possibly collect can be reduced, and the waterproof performance of the waterproof sheet 30 can be further improved.

Figure 6:
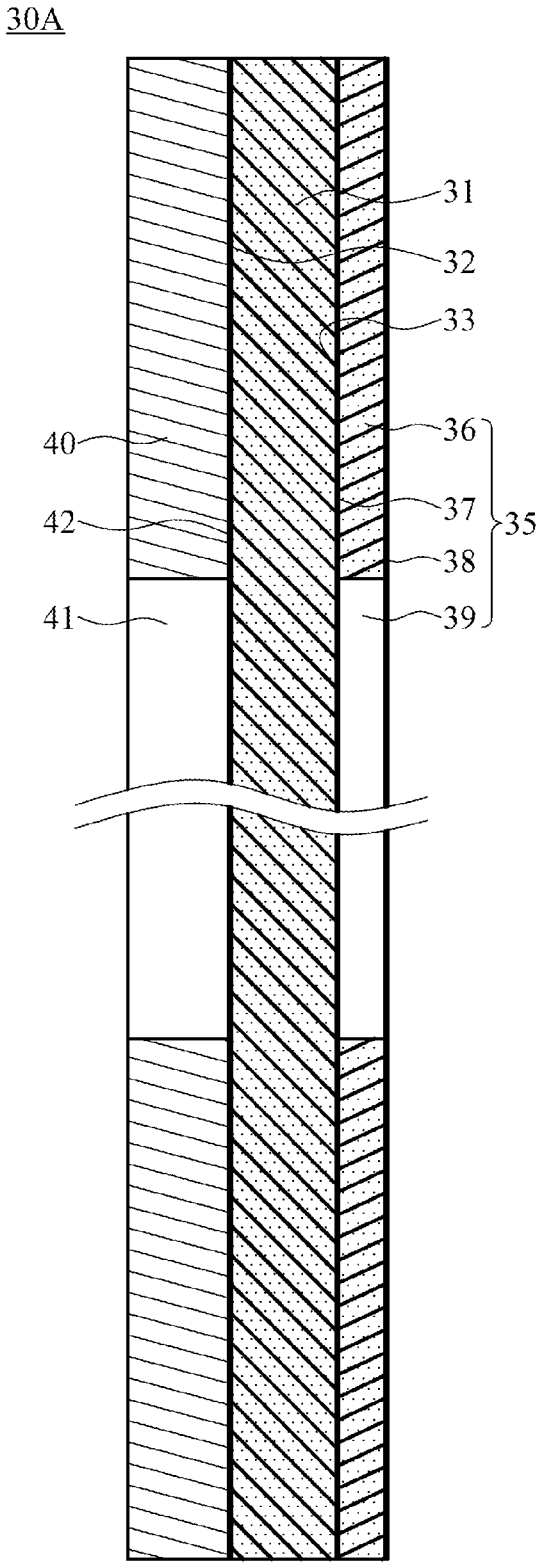
FIG. 6 is a sectional view of the waterproof sheet according to another exemplary embodiment of the instant disclosure.

As shown in FIG. 6, the waterproof sheet 30A according to another exemplary embodiment of the instant disclosure is provided. In this embodiment, the waterproof sheet 30A further comprises an enforcing layer 40 boned to the outer side surface 32 of the waterproof foam layer 31. The enforcing layer 40 is formed with a central through hole 41 positioned with the central through hole 39. Specifically, the enforcing layer 40 may have an annular shape, and the central via hole 41 is positioned with the central through hole 39 and the sound guiding opening 11 to prevent the sound from being blocked by the waterproof sheet 30A. The enforcing layer 40 may be a rigid material layer, for example, the enforcing layer 40 may be a plastic sheet or an acrylic sheet. Alternatively, the enforcing layer 40 may be a tough material layer, for example, the enforcing layer 40 may be a silicone sheet, a rubber sheet, or a polyester film. In a further option, the enforcing layer 40 may be a waterproof foam layer. For example, the enforcing layer 40, the waterproof foam layer 31 and the waterproof foam member 36 are all made of closed-cell foam. Consequently, the overall rigidness of the waterproof sheet 30A can be further increased, and the waterproof sheet 30A can be assembled to the housing 10 more conveniently and easily.

Further, as shown in FIG. 6, in this embodiment, the enforcing layer 40 further comprises an adhesive side surface 42 bonded to the outer side surface 32 of the waterproof foam layer 31. For example, the enforcing layer 40 is attached to the outer side surface 32 of the waterproof foam layer 31 by means of gluing, and the instant disclosure is not limited thereto. In an alternative embodiment, the enforcing layer 40 may be attached to the outer side surface 32 of the waterproof foam layer 31 by means of ultrasonic welding or high-frequency welding. The adhesive side surface 42 may be waterproof to further improve the waterproof function of the waterproof sheet 42.

Figure 7:
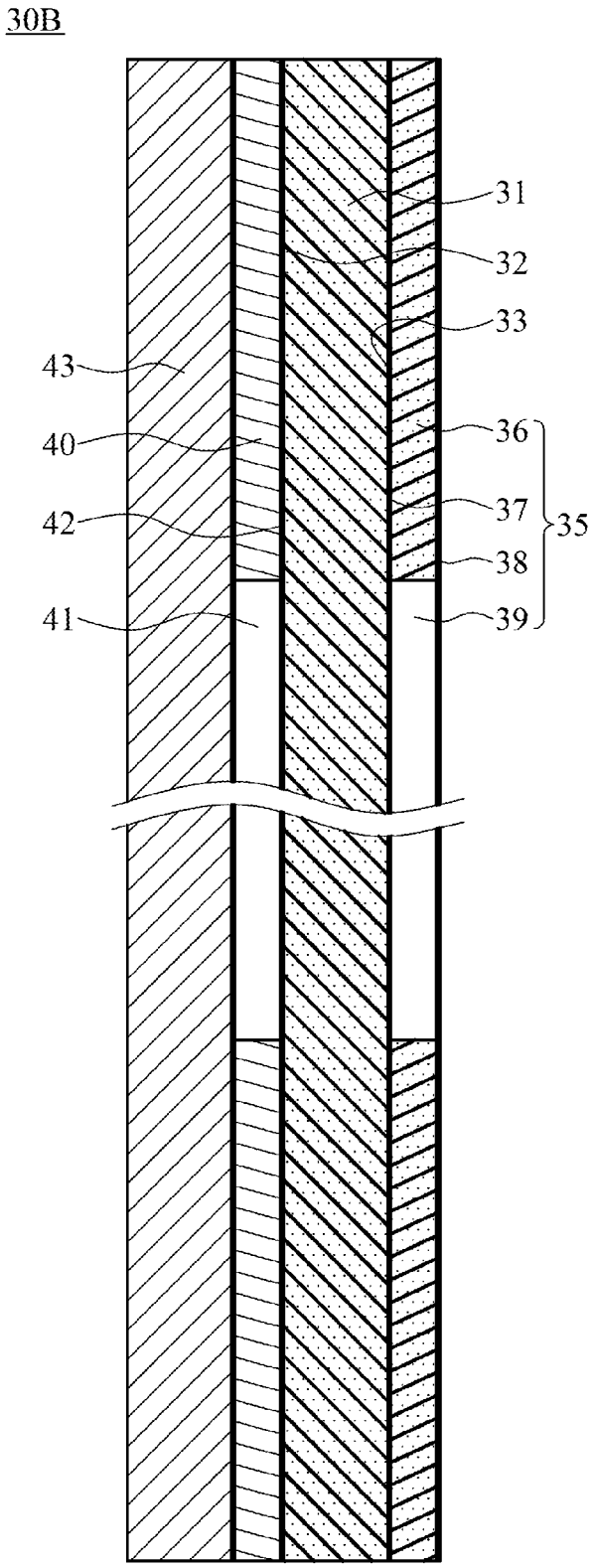
FIG. 7 is a sectional view of the waterproof sheet according to yet another exemplary embodiment of the instant disclosure.

As shown in FIG. 7, the waterproof sheet 30B according to yet another exemplary embodiment of the instant disclosure is provided. In this embodiment, the enforcing layer 40 of the waterproof sheet 30B may comprise an outer decorating member 43 (e.g., a decorating plate or a mesh plate), and the outer decorating member 43 is adapted opposite to the adhesive side surface 42 (the adhesive side surface 42 and the outer decorating member 43 are respectively adapted to two opposite surfaces of the enforcing layer 40). The outer decorating member 43 may be attached to the enforcing layer 40 by means of gluing, ultrasonic welding, high-frequency welding, etc. In an alternative embodiment, the enforcing layer 40 may comprise, similar to the waterproof double-sided adhesive layer 35, a foam member and two adhesive side surfaces at two opposite surfaces of the foam member, such that the outer decorating member 43 can be adhered thereto and that the enforcing member 40 with the outer decorating member 43 can be adhered to the outer side surface 32 of the waterproof foam layer 31.

Based on the above, the waterproof sheet comprises the waterproof foam layer and the waterproof double-sided adhesive layer, as compared with the typical specified waterproof permeable film, the manufacturing cost of the waterproof sheet can be reduced, and the waterproof performance of the waterproof sheet can be improved. In addition, due to the waterproof function of the waterproof sheet would not be affected by human finger touch, the convenience and the effectiveness for manufacturing and assembling the waterproof sheet will be increased, and the yield of the product can be greatly improved.

While the disclosure has been described by way of examples and in terms of preferred embodiments, it is to be understood that the invention is not limited to the disclosed embodiments. On the contrary, the intent is to cover various modifications and similar arrangements, which are within the spirit and scope of the appended claims, the scope of which should be accorded the broadest interpretation so as to encompass all such modifications and similar structures.

What is claimed is:

1. An electronic device, comprising:

a housing having a sound guiding opening;

a sound unit assembled inside the housing and positioned with the sound guiding opening; and a waterproof sheet that covers the sound guiding opening, the waterproof sheet comprising a waterproof foam layer and a waterproof double-sided adhesive layer, the waterproof foam layer comprising an outer side surface and an inner side surface opposite to the outer side surface, the waterproof double-sided adhesive layer comprising a waterproof foam member, a first waterproof adhesive side surface, and a second waterproof adhesive side surface, the first waterproof adhesive side surface and the second waterproof adhesive side surface being located at two opposite surfaces of the waterproof foam member, respectively, the first waterproof adhesive side surface being bonded to the inner side surface of the waterproof foam layer, the waterproof double-sided adhesive layer further comprising a central through hole passing through the waterproof foam member, the first waterproof adhesive side surface, and the second waterproof adhesive side surface;

wherein, the second waterproof adhesive side surface is bonded to the outer surface of the housing, and the central through hole is positioned with the sound guiding opening.

2. The electronic device according to claim 1, wherein the size of the central through hole is greater than or equal to the size of the sound guiding opening.

3. The electronic device according to claim 1, wherein the sound unit is a speaker unit.

4. The electronic device according to claim 1, wherein the sound unit is a microphone unit.

5. The electronic device according to claim 1, wherein the housing having a recess formed at one side thereof, the sound guiding opening is in fluid communication with the recess, and the waterproof sheet is positioned in the recess.

6. The electronic device according to claim 1, wherein the edge of the waterproof double-sided adhesive layer is aligned with the edge of the waterproof foam layer.

7. The electronic device according to claim 1, further comprising an enforcing layer bonded to the outer side surface of the waterproof foam layer, wherein the enforcing layer is formed with a central via hole positioned with the central through hole.

8. The electronic device according to claim 7, wherein the enforcing layer is a rigid material layer.

9. The electronic device according to claim 7, wherein the enforcing layer is a polyester thin film layer.

10. The electronic device according to claim 7, wherein the enforcing layer is a waterproof foam.

11. The electronic device according to claim 7, wherein the enforcing layer further comprises an adhesive side surface bonded to the outer side surface of the waterproof foam layer.

12. The electronic device according to claim 11, wherein the enforcing layer further comprises an outer decorating member positioned opposite to the adhesive side surface.

13. A waterproof sheet, comprising:

a waterproof foam layer comprising an outer side surface and an inner side surface opposite to the outer side surface; and a waterproof double-sided adhesive layer comprising a waterproof foam member, a first waterproof adhesive side surface, and a second waterproof adhesive side surface, the first waterproof adhesive side surface and the second waterproof adhesive side surface being located at two opposite surfaces of the waterproof foam member, respectively, the first waterproof adhesive side surface being bonded to the inner side surface of the waterproof foam layer, wherein the waterproof double-sided adhesive layer further comprises a central through hole passing through the waterproof foam member, the first waterproof adhesive side surface, and the second waterproof adhesive side surface.

14. The waterproof sheet according to claim 13, further comprising an enforcing layer bonded to the outer side surface of the waterproof foam layer, wherein the enforcing layer is formed with a central via hole positioned with the central through hole.

15. The waterproof sheet according to claim 13, wherein the edge of the waterproof double-sided adhesive layer is aligned with the edge of the waterproof foam layer.

16. The waterproof sheet according to claim 14, wherein the enforcing layer is a rigid material layer.

17. The waterproof sheet according to claim 14, wherein the enforcing layer is a polyester thin film layer.

18. The waterproof sheet according to claim 14, wherein the enforcing layer is a waterproof foam.

19. The waterproof sheet according to claim 14, wherein the enforcing layer further comprises an adhesive side surface bonded to the outer side surface of the waterproof foam layer.

20. The waterproof sheet according to claim 19, wherein the enforcing layer further comprises an outer decorating member positioned opposite to the adhesive side surface.

* * * * *